US005992129A

United States Patent [19]

Tuckner et al.

[11] Patent Number: 5,992,129

[45] Date of Patent: Nov. 30, 1999

[54] ORIENTING APPARATUS FOR AN ORIENTATIONALLY SENSITIVE CLOSURE

[75] Inventors: Ron Tuckner, White Bear Lake; Bengt Bengtsson, Woodbury, both of Minn.; Ken Nortman, Black River Falls, Wis.; Glen Peterson, Eagan, Minn.

[73] Assignee: Tetra Laval Holdings & Finance, SA, Pully, Switzerland

[21] Appl. No.: 08/996,606

[22] Filed: Dec. 23, 1997

Related U.S. Application Data

[63] Continuation-in-part of application No. 08/812,319, Mar. 5, 1997, Pat. No. 5,852,913.

[51] Int. Cl.[6] ..... B65B 7/28; B67B 3/28; B65D 5/74

[52] U.S. Cl. ..... 53/367; 53/133.2; 198/382; 198/399

[58] Field of Search ..... 53/367, 31, 489, 53/485, 133.2; 198/417, 400, 399, 394, 390, 389, 382

[56] References Cited

U.S. PATENT DOCUMENTS

| | | | |
|---|---|---|---|
| 3,408,788 | 11/1968 | Greck | 53/367 X |
| 4,696,143 | 9/1987 | Young | 53/367 X |
| 5,150,559 | 9/1992 | Winfield | 53/367 X |
| 5,159,797 | 11/1992 | Herzog | 53/367 X |
| 5,601,669 | 2/1997 | Moody et al. | 156/73.1 |

*Primary Examiner*—James F. Coan

[57] ABSTRACT

The orienting device of the present invention will properly orient a closure which is transferred from a hopper to be applied to a container in connection with a form, fill and seal packaging machine. The present invention will also maintain the orientation on an anvil as the anvil moves the closure from the orienting device to a container through exertion of a vacuum on the closure. The present invention also discloses a specific closure for use with an overall orienting closure system. The orienting device will have at least two channels which maintain the closure as the closure is oriented into a desired position.

12 Claims, 13 Drawing Sheets

ORIENTING APPARATUS FOR AN ORIENTATIONALLY SENSITIVE CLOSURE

CROSS REFERENCES TO RELATED APPLICATIONS

This application is a continuation in part of U.S. patent application Ser. No. 08/812,319, filed Mar. 5, 1997, now U.S. Pat. No. 5,852,913, which is hereby incorporated by reference.

STATEMENT REGARDING FEDERALLY SPONSORED RESEARCH OR DEVELOPMENT

Not Applicable

BACKGROUND OF THE INVENTION

1. Field of the Invention

The present invention relates to an apparatus for orienting a fitment on a container. Specifically, the present invention relates to an apparatus for orienting an orientationally sensitive fitment on a carton.

2. Description of the Related Art

Containers having spout-like closures for dispensing the contents therefrom have come into widespread use. One such type of closure includes a threaded spout extending upwardly from a container. The closure is used with a cap that threadly engages the spout. Frequently, such closures are injection molded directly onto the container material stock. Such closures may, however, be formed separate from the container and subsequently mounted thereto. For certain applications, such closures have shown significant advantages over known closure systems.

Another known type of closure includes a one-piece molded body having a hinged cap. Such one piece closures advantageously eliminate the need for a separately formed closure cap. The one-piece configuration eliminates the possibility of losing or inadvertently discarding the separate cap portion.

One drawback to using such hinged closures is that each closure must be properly oriented on its respective container because each closure cover hinges or pivots about an axis particularly located on the closure. For example, the cover portion of a hinged closure that is mounted to a gable top carton must pivot upwardly, out of the way of the contents being dispensed or poured from the container. If the cover pivots in a manner or direction other than upwardly, it may interfere with dispensing or pouring of the contents therefrom.

In another application, it may be desired to position a non-hinged closure, such as a threaded closure package, in a particular orientation on a container. Such particularized orientation of the closure may be, for example, to effect the proper positioning of indicia on the closure or closure cap relative to the container. This may be significant if the indicia contains a logo, trademark or like representation.

Known orientable closures typically have one or more flattened sides to facilitate proper orientation of the closure on the container. Inasmuch as such partially flattened closures are acceptable for hinged type closures, there are a number of drawbacks. First, such flattened sides may increase the cost to manufacture such closures. In addition, handling and positioning of such closures could require additional capital equipment for sorting, positioning and mounting the closures to containers. Moreover, such flattened closures are difficult to use in conjunction with a threaded-type closure arrangement.

Accordingly, there continues to be a need for an orientationally sensitive closure and an orienting apparatus for use with such a closure. Such a closure and apparatus should readily orient the closure for proper positioning for mounting to a container. Such a closure should include a hinged cover portion that opens away from the dispensing direction. Advantageously, such a closure may include directionally sensitive indicia, such as logos and the like, which indicia should be properly oriented on the closure.

BRIEF SUMMARY OF THE INVENTION

The present invention resolves the problems of the closure orientation by providing an apparatus which may be an integrated component or an add-on component of a fitment applicator for a form, fill and seal packaging machine. The present invention is able to resolve the problems of the past by taking advantage of the inherent features of closures.

One aspect of the present invention is an apparatus for orienting a closure prior to mounting the closure on a container. The apparatus includes a closure inlet region and a closure outlet region oppositely located from one another on an apparatus body. The body defines a longitudinally oriented flange receiving channel having a width configured to slidingly receive the closure flange, and a projection receiving channel extending generally longitudinally along half of the body portion. The projection receiving channel has at least one bend therein, such that a closure, positioned at the inlet and traversing through the apparatus, is rotationally oriented by interaction of the projection and the projection receiving channel to discharge the closure by the leading edge first, i.e., the leading edge in a leading position.

Another aspect of the present invention is an orientationally sensitive closure adapted for mounting to a container in a specific orientation or direction. The closure is a hinged typed closure having a mounting flange. The closure has a cap and spout arrangement positioned centrally on, and generally coaxially with the flange. An orienting projection extends from the opposite side of the flange, in a non-coaxial relation to the spout and flange. The flange is generally circular except for a flat section. The flat section assists in maintaining the proper orientation during application of the closure on the apparatus of the present invention.

Yet another aspect of the present invention is a vacuum holding device for maintaining the proper orientation of an oriented closure on an anvil for placement within a container for attachment thereto. The vacuum holding device has a channel integrated into a closure receiving portion of the anvil. The vacuum maintains a flat closure in place on the anvil during transport from the orienting apparatus to a container.

It is a primary object of the present invention to provide an apparatus for orienting a closure on a fitment applicator.

It is an additional object of the present invention to provide an orientationally sensitive closure.

It is yet an additional object of the present invention to provide a vacuum holding device for maintaining the orientation of a closure on an anvil during transport from the orienting apparatus to a container.

It is yet an additional object of the present invention to provide a closure orienting system for properly orienting a closure on a container.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which:

There is illustrated in FIG. 1 a top plan view of the closure of the present invention;

Figure 1:
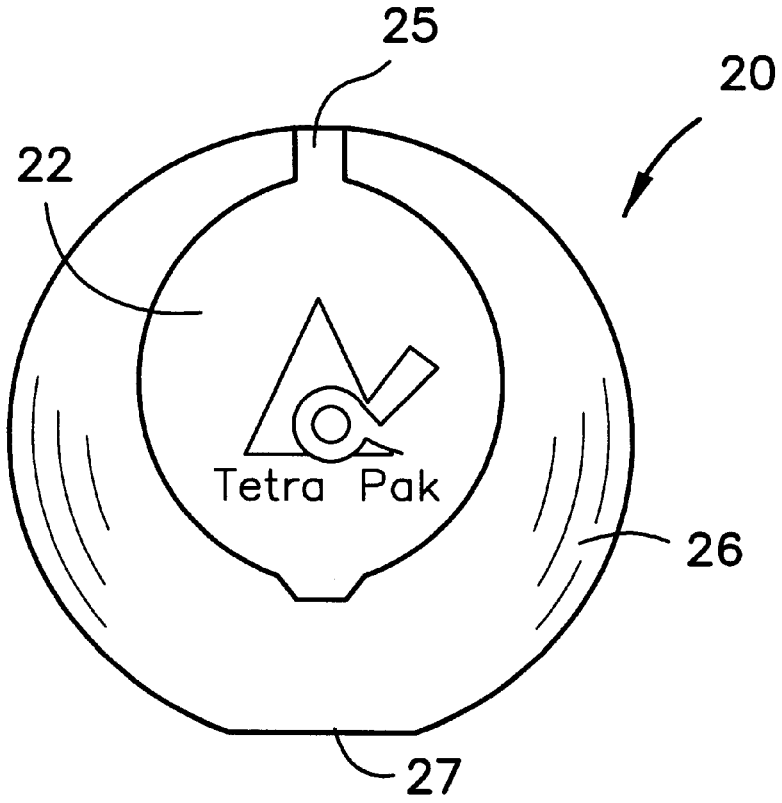
Figure 2:
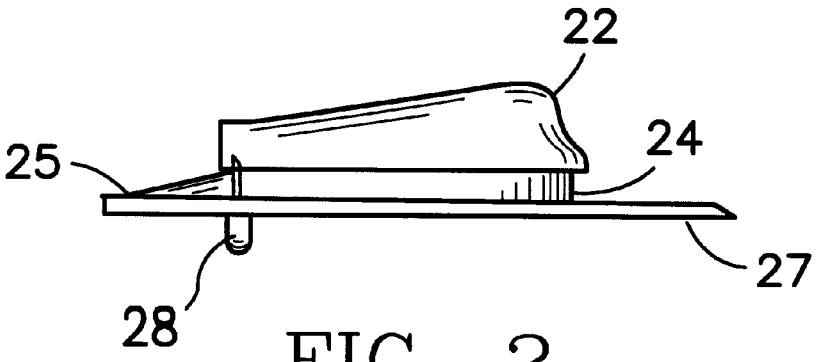
Figure 3:
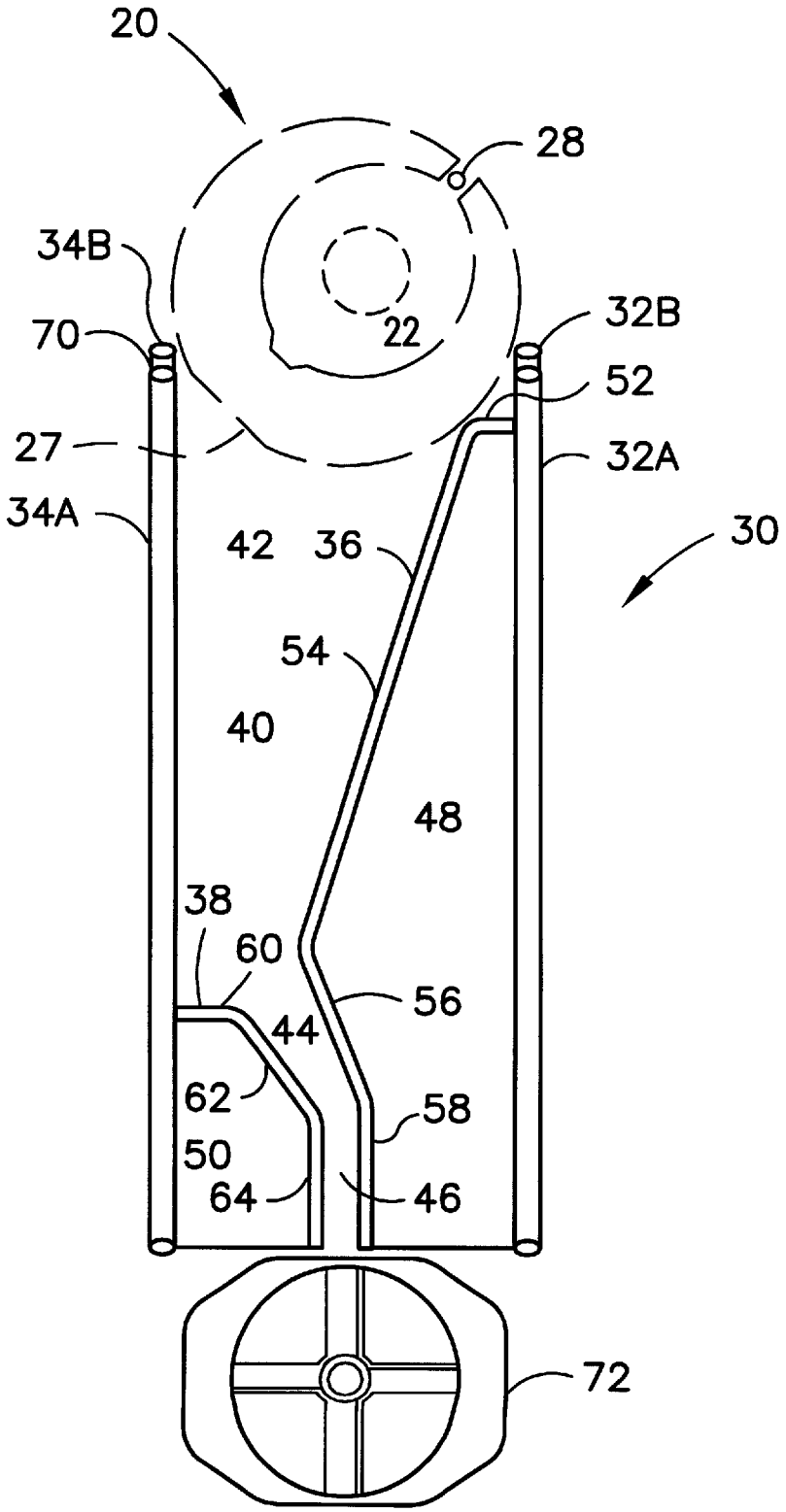
Figure 4:
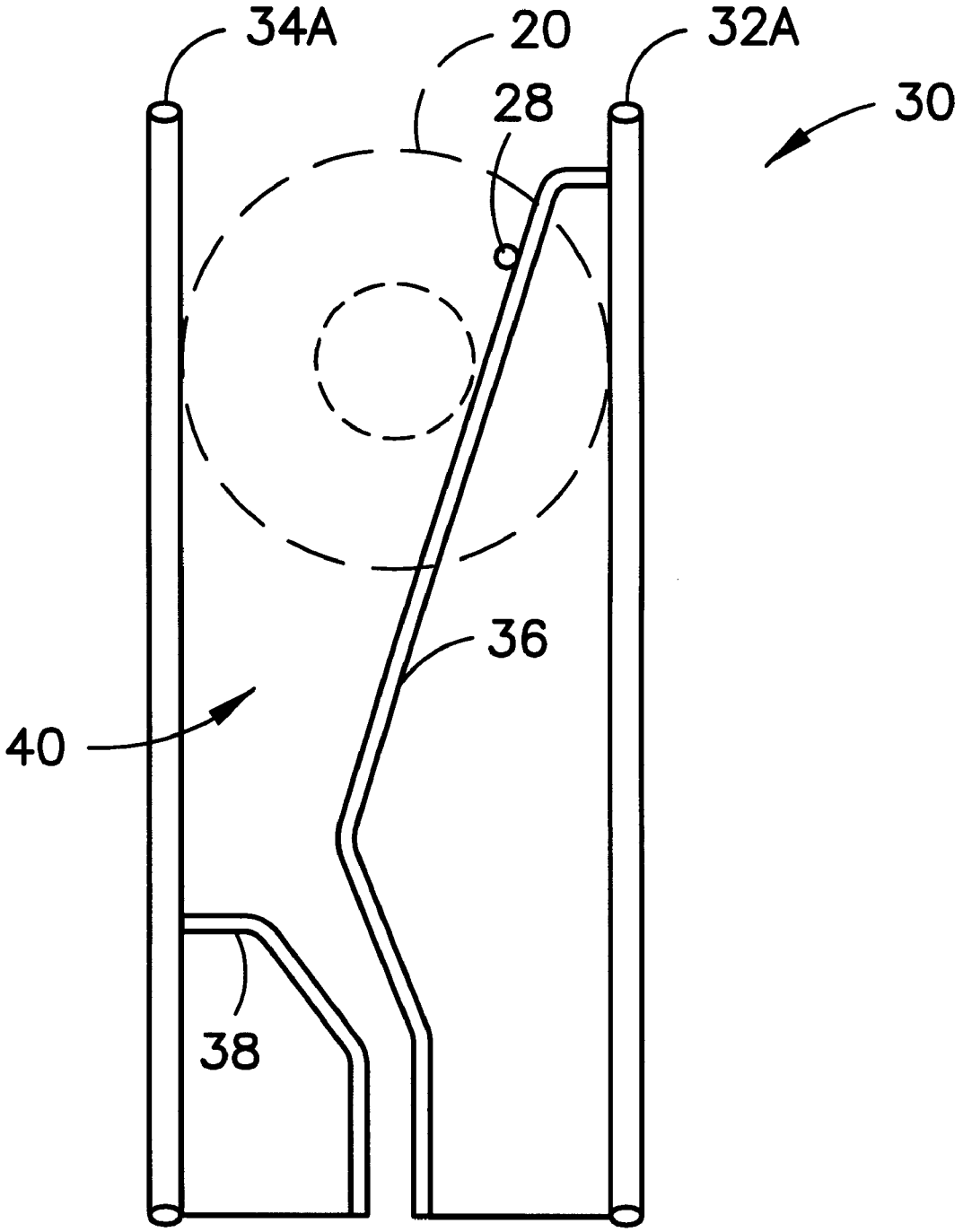
Figure 5:
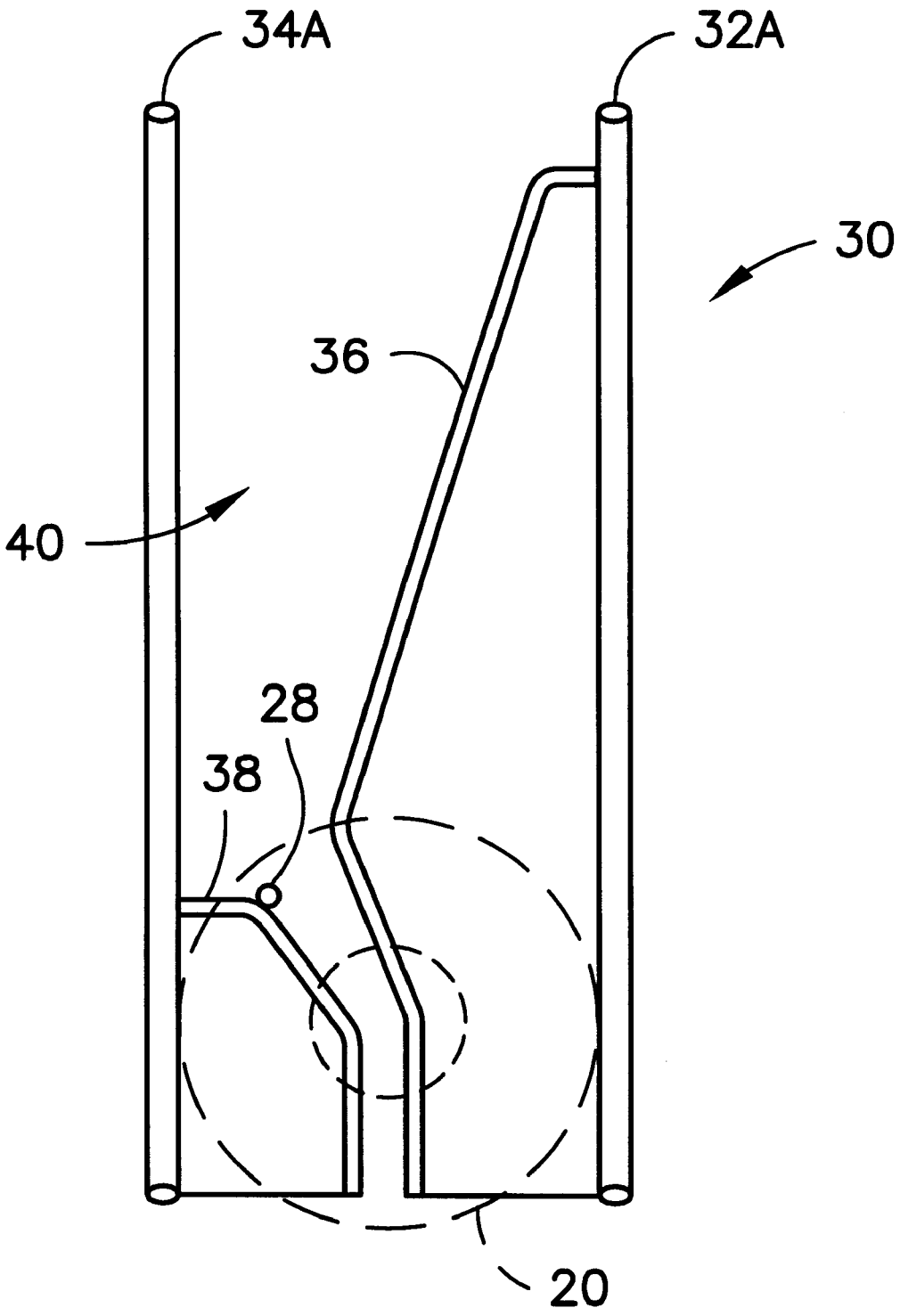
Figure 6:
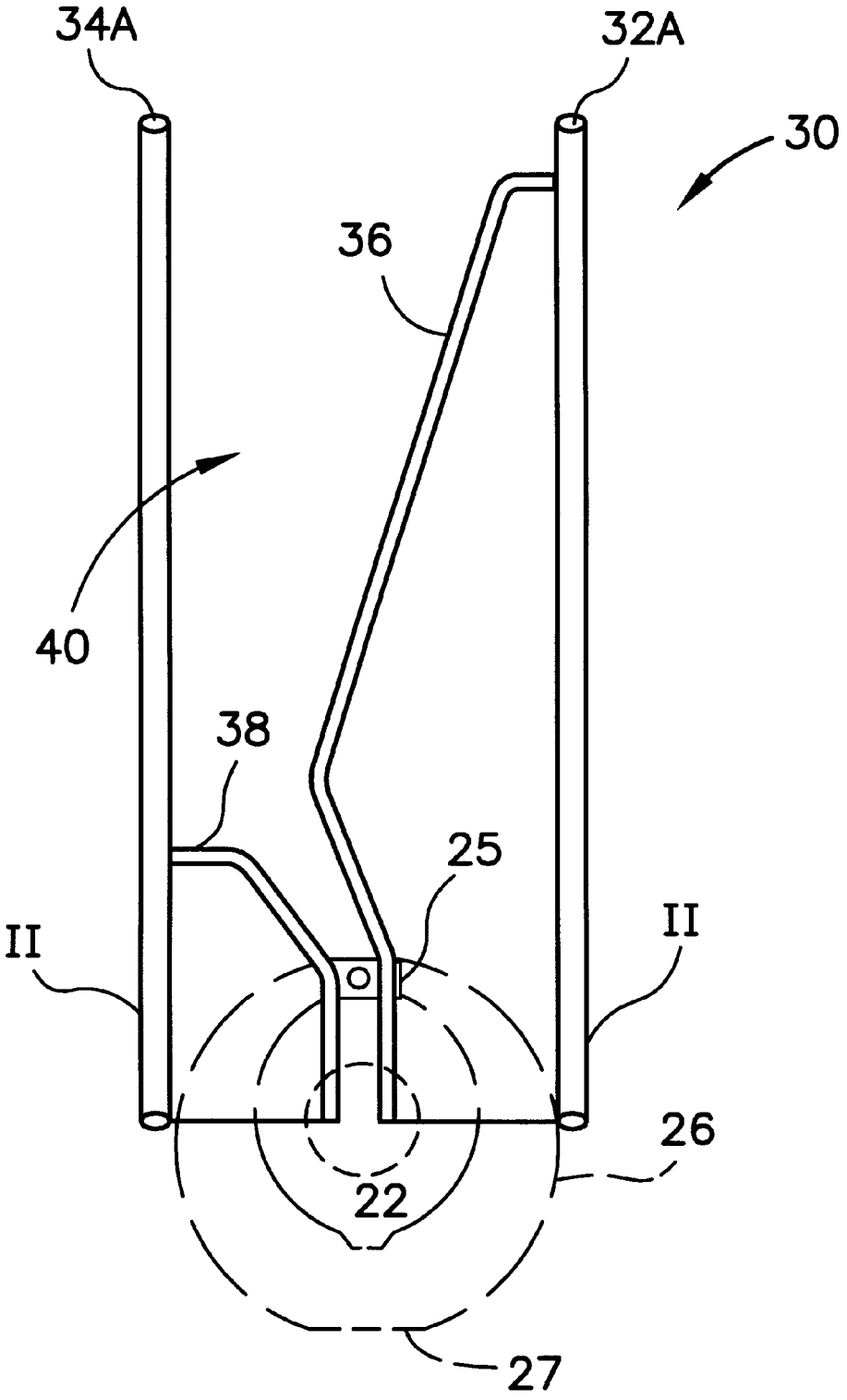
Figure 6A:
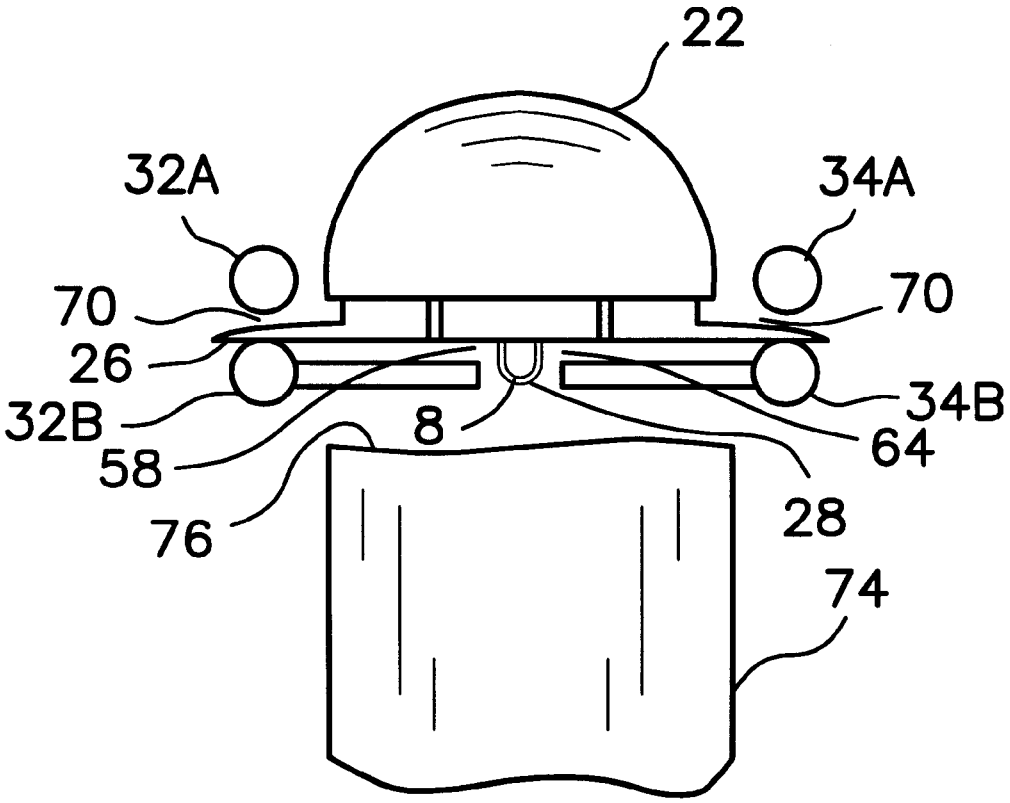
Figure 7:
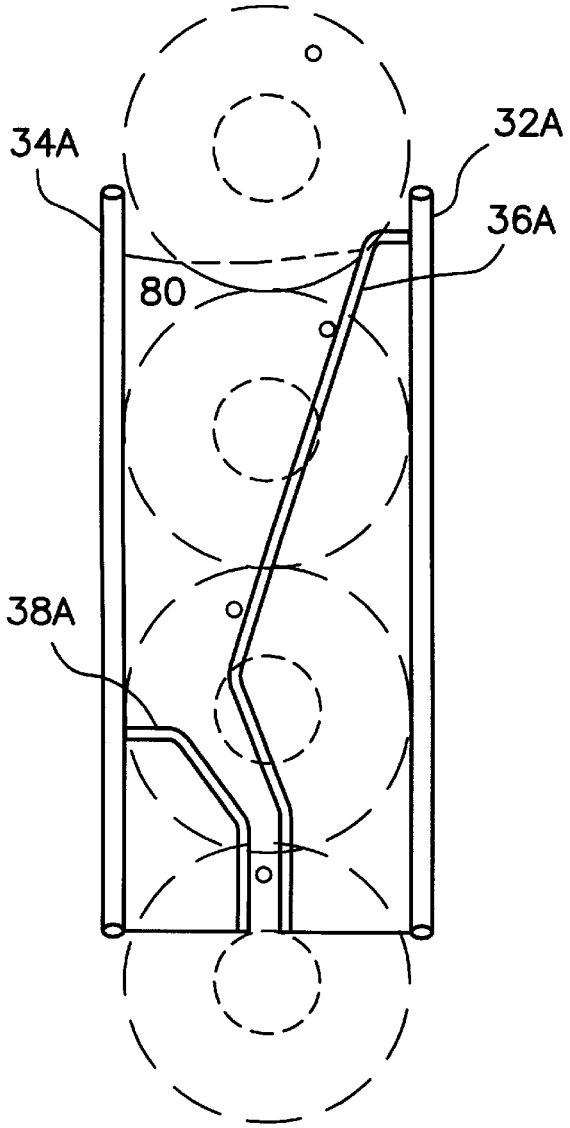
Figure 7A:
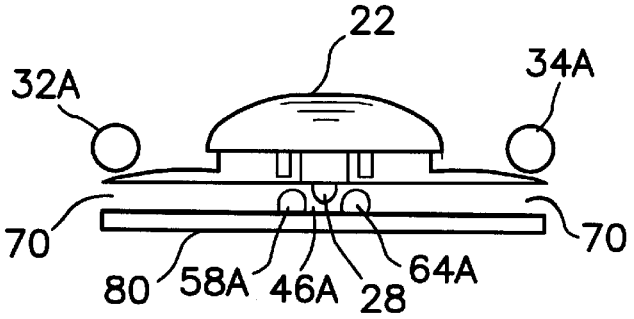
Figure 8:
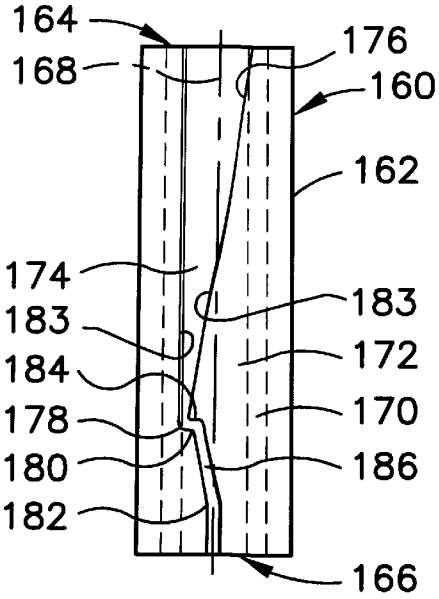
Figure 9:
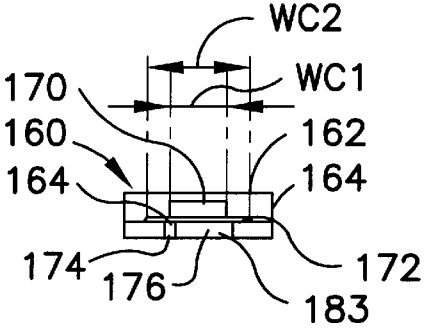
Figure 10A:
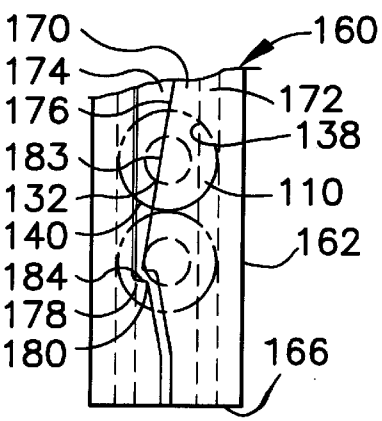
Figure 10B:
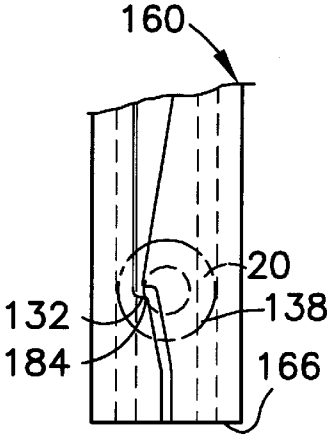
Figure 10C:
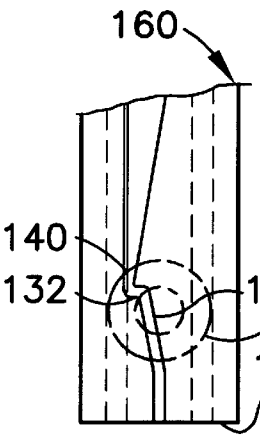
Figure 10D:
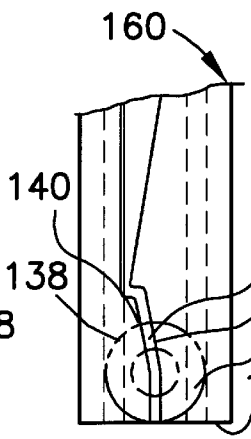
Figure 10E:
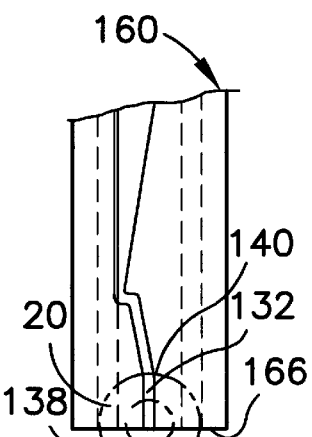
Figure 13:
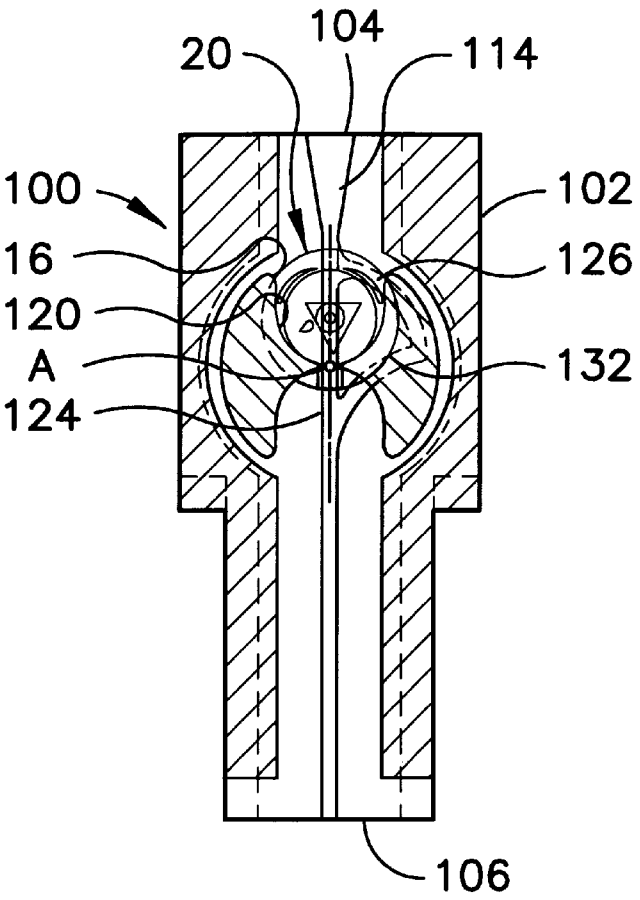
Figure 11:
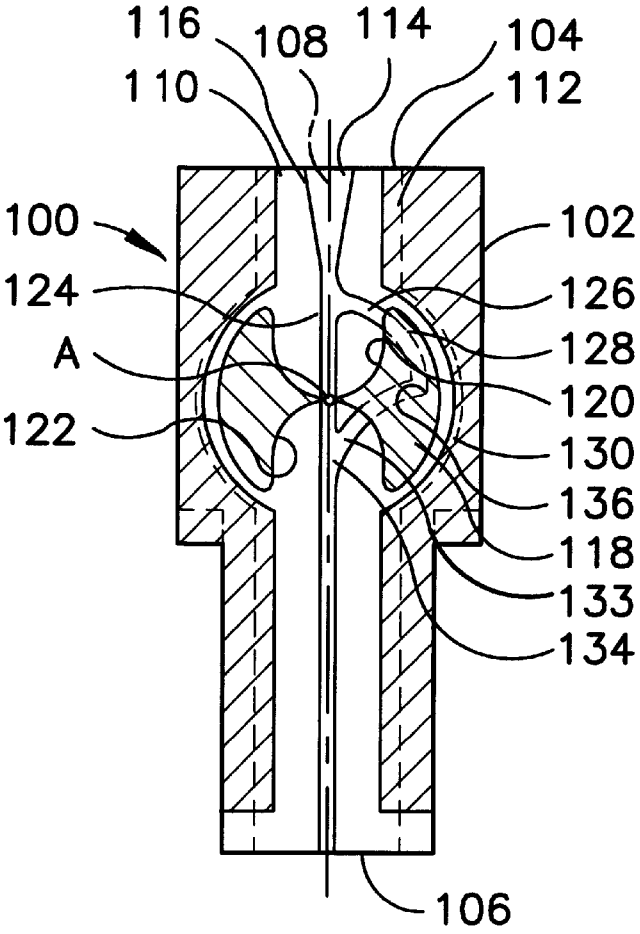
Figure 12D:
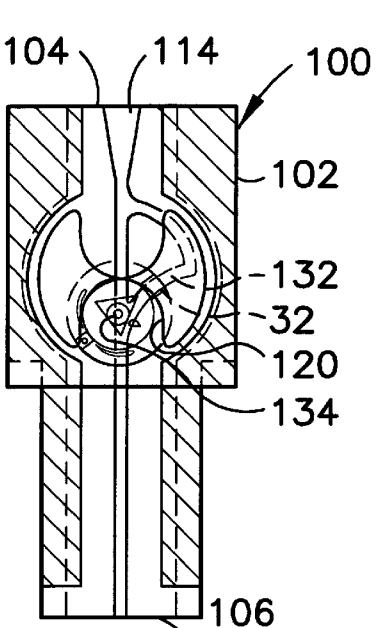
Figure 12C:
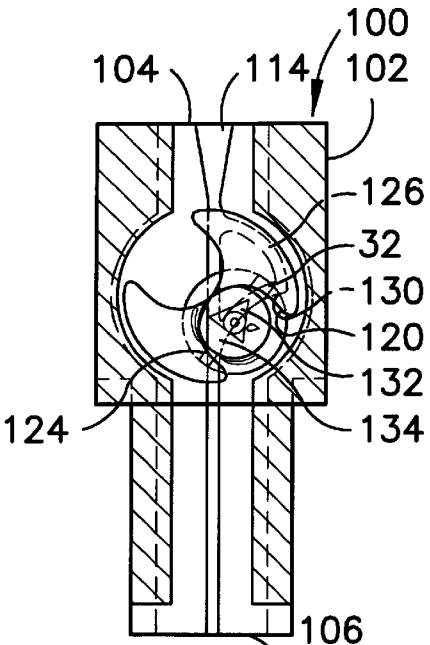
Figure 12B:
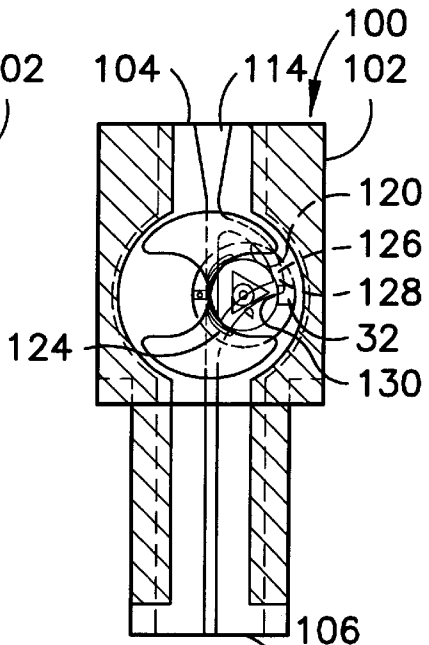
Figure 12A:
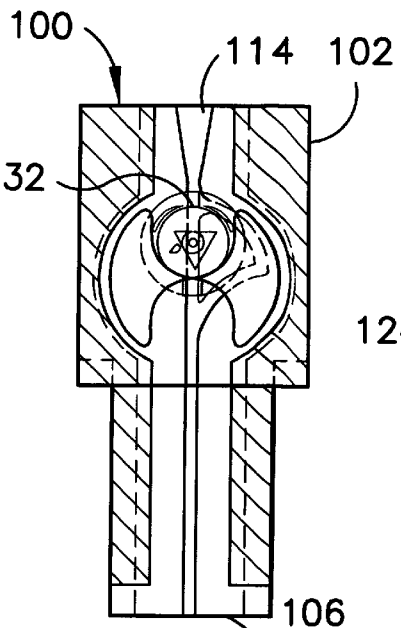
Figure 14:
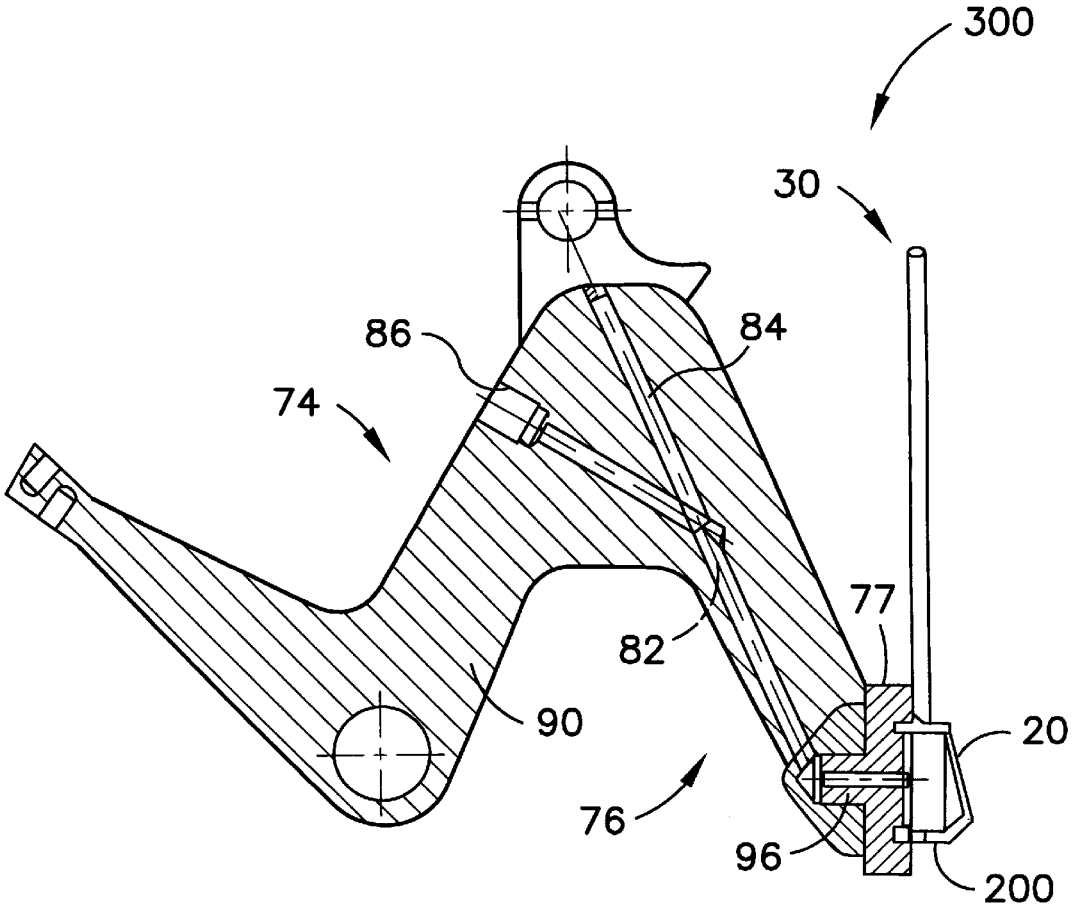
Figure 15:
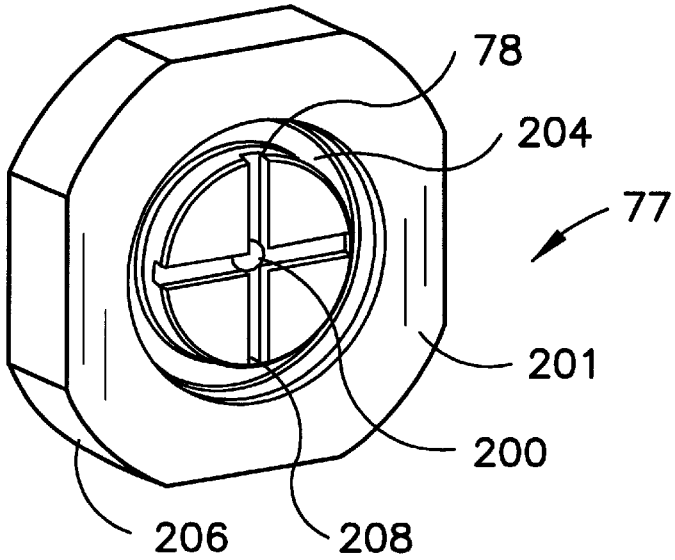
Figure 16:
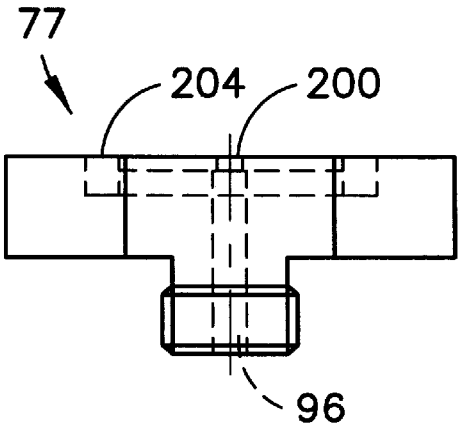
Figure 17:
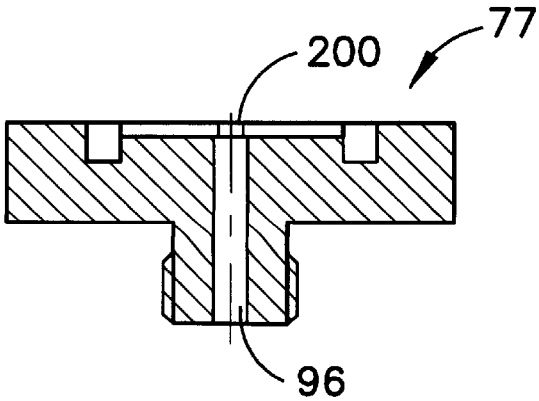
Figure 18:
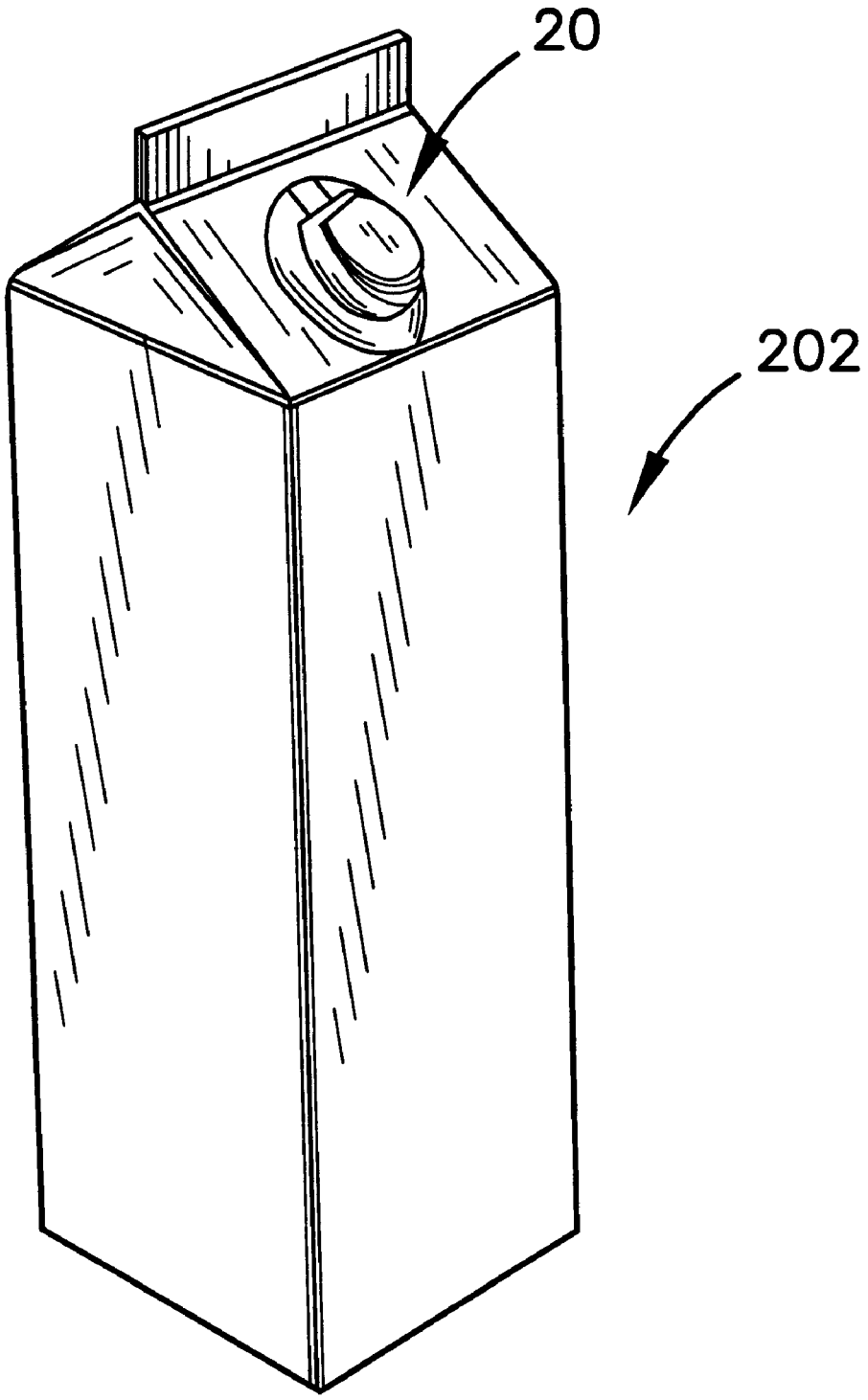
Figure 1:
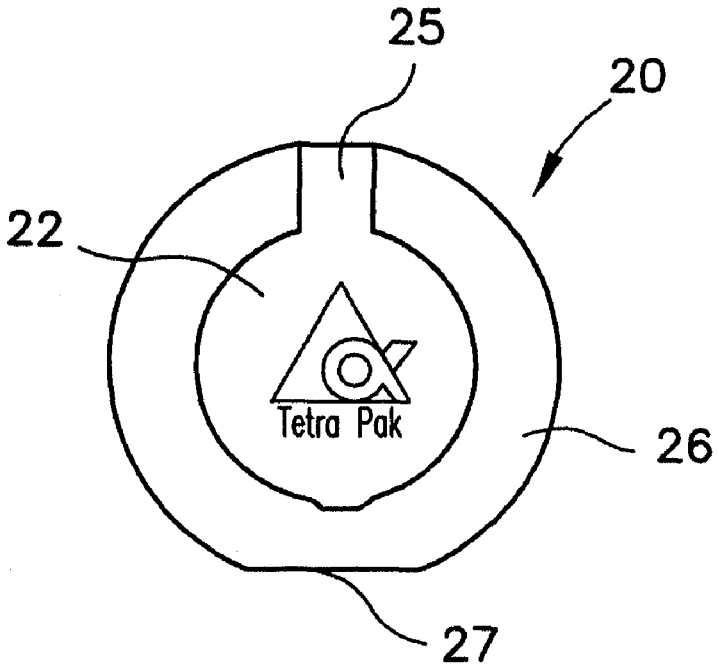
Figure 2:
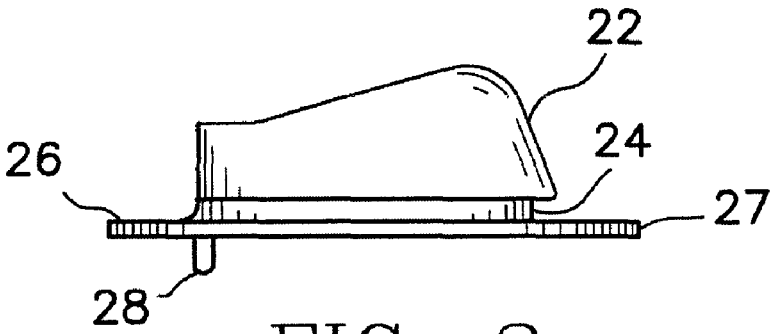
Figure 3:
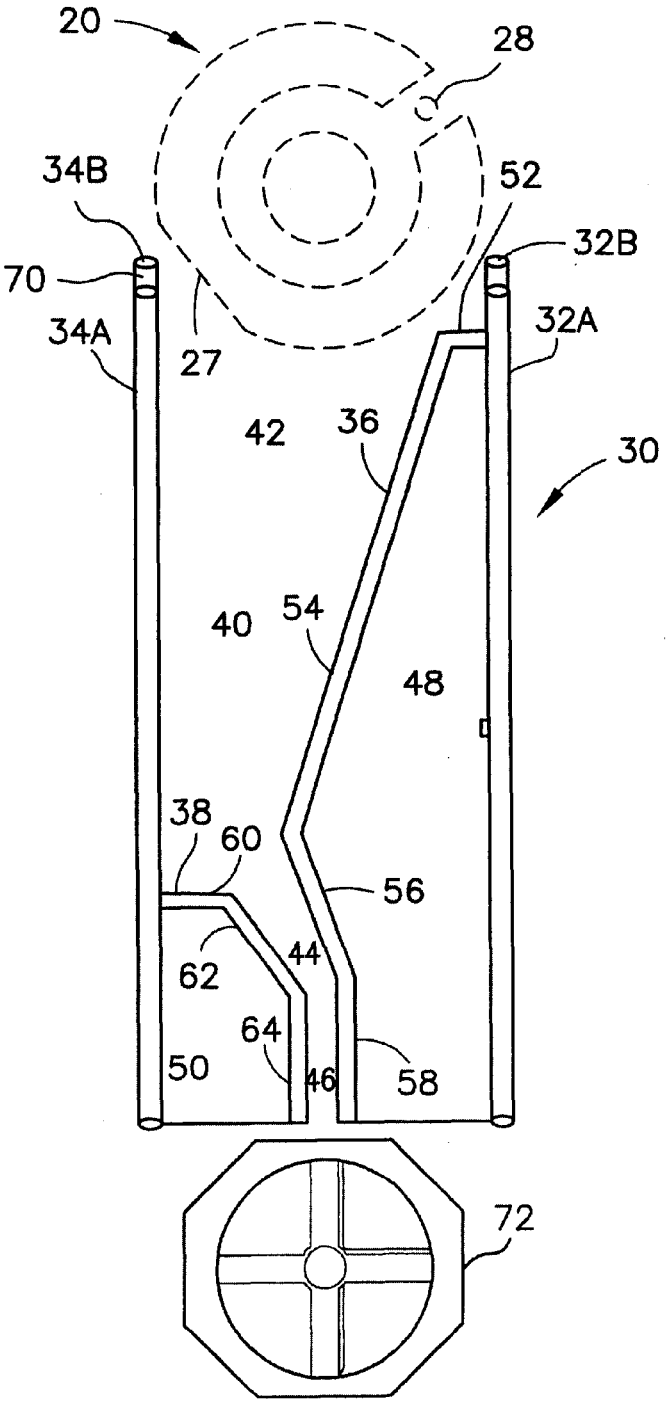
Figure 4:
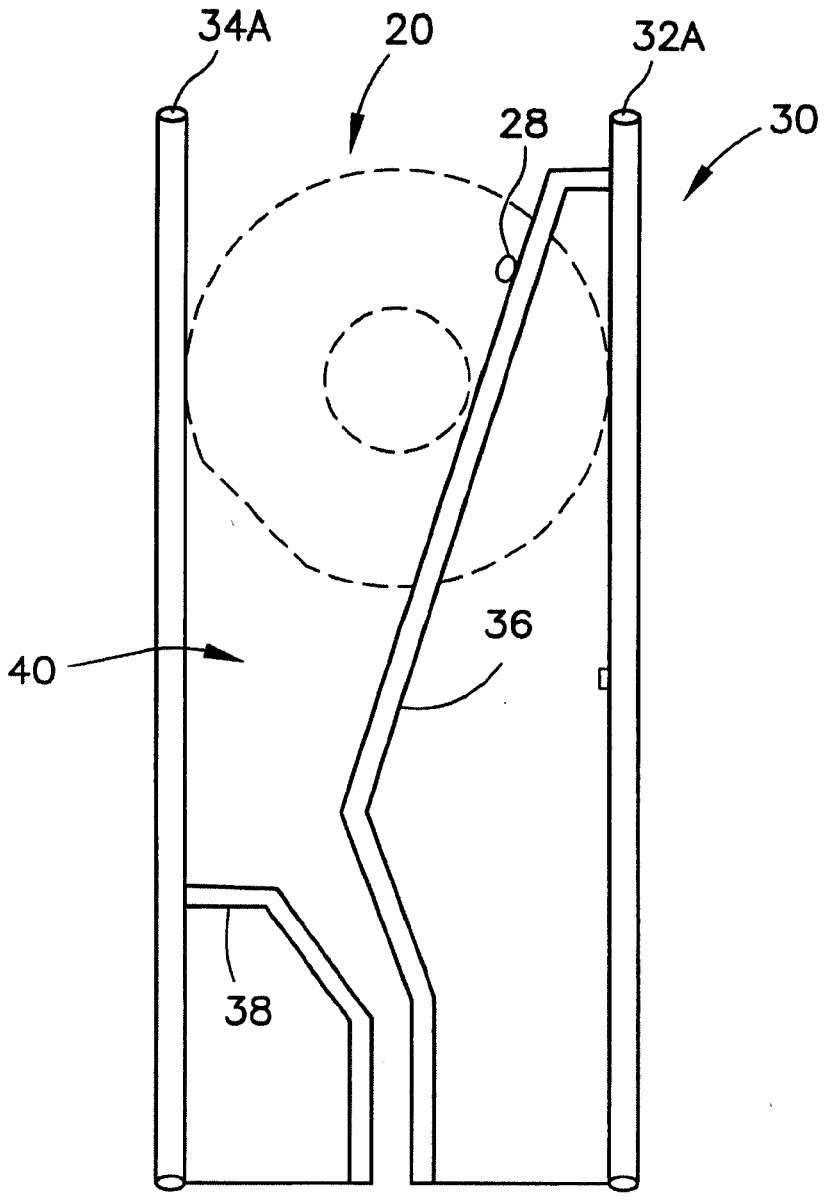
Figure 5:
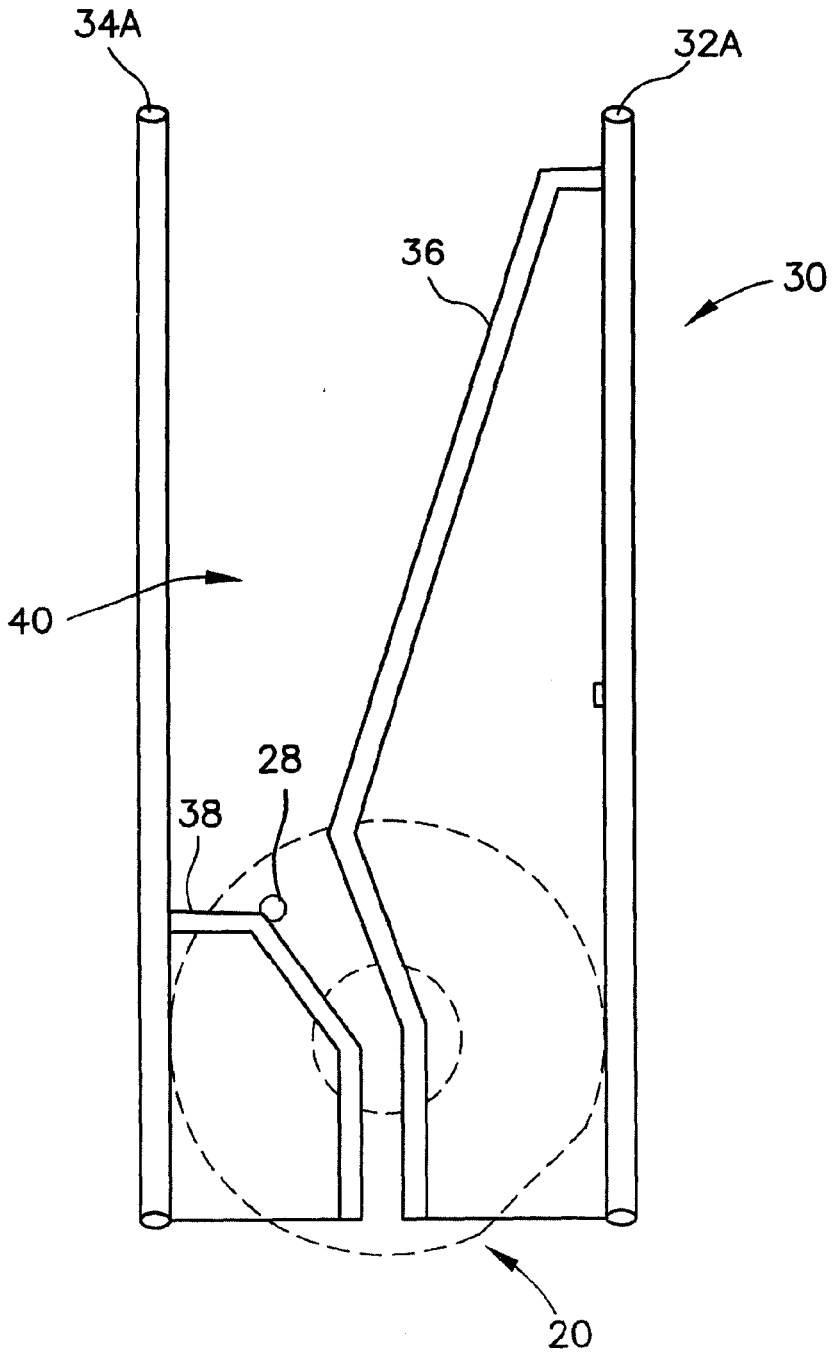
Figure 6:
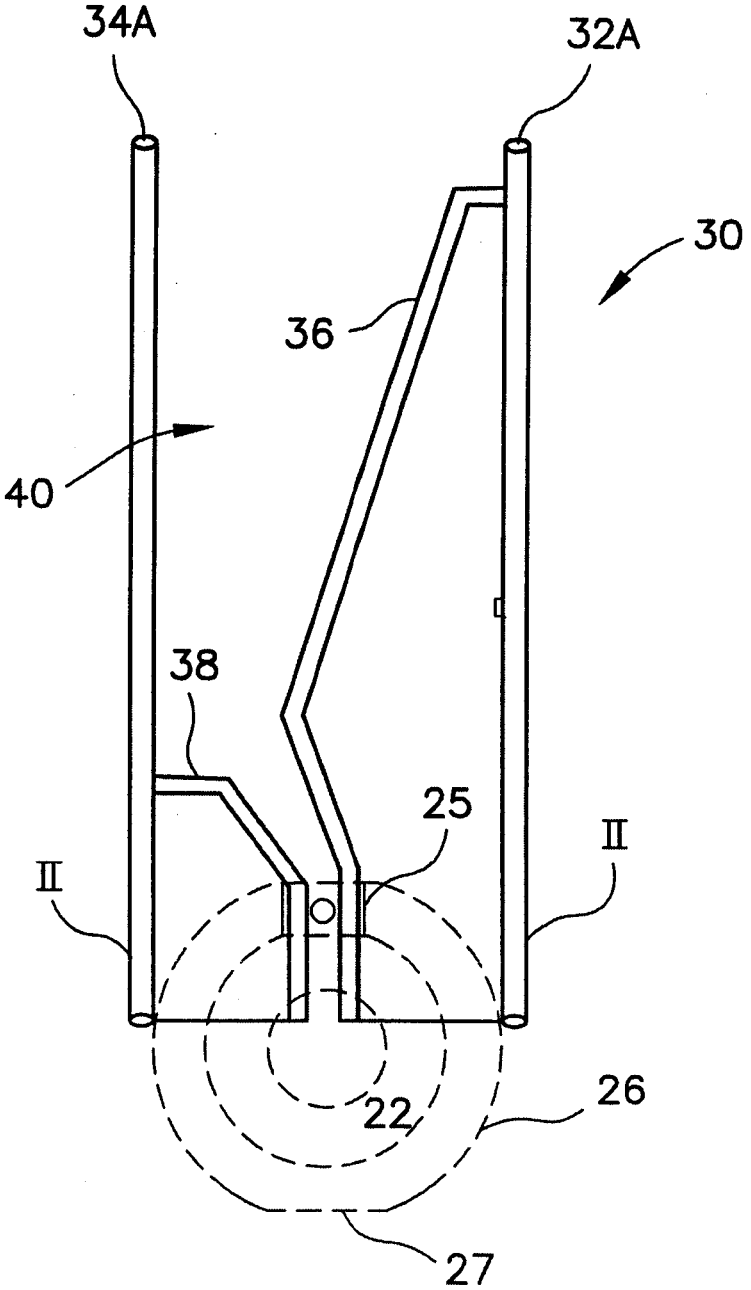
Figure 6A:
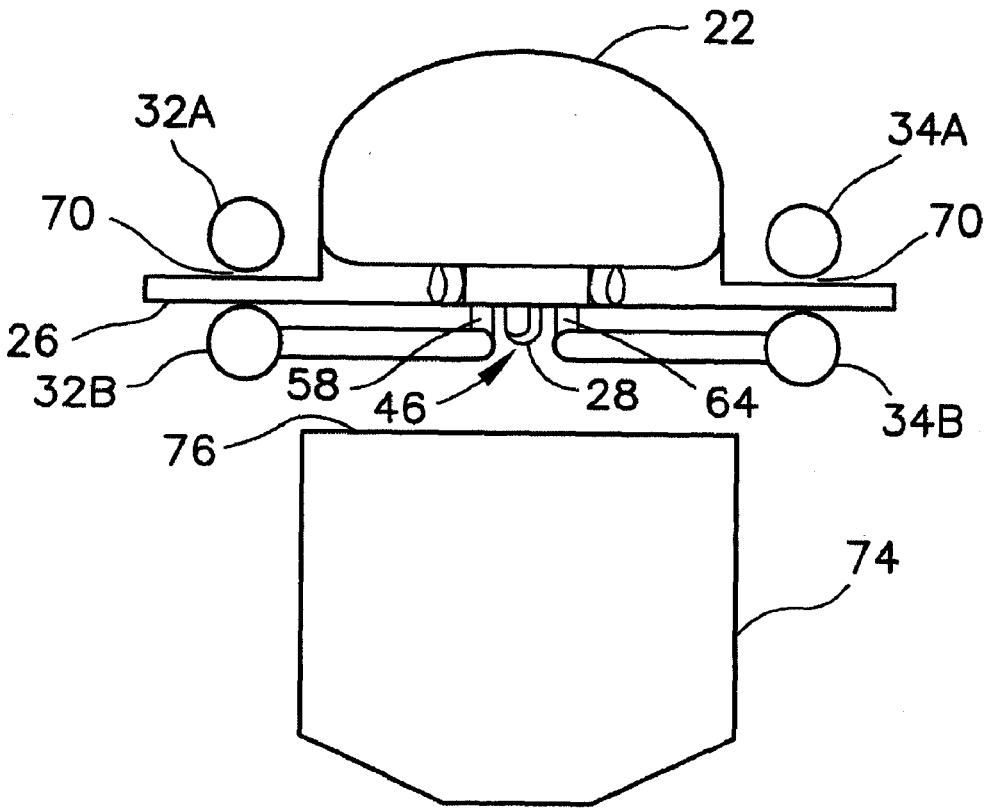
Figure 7:
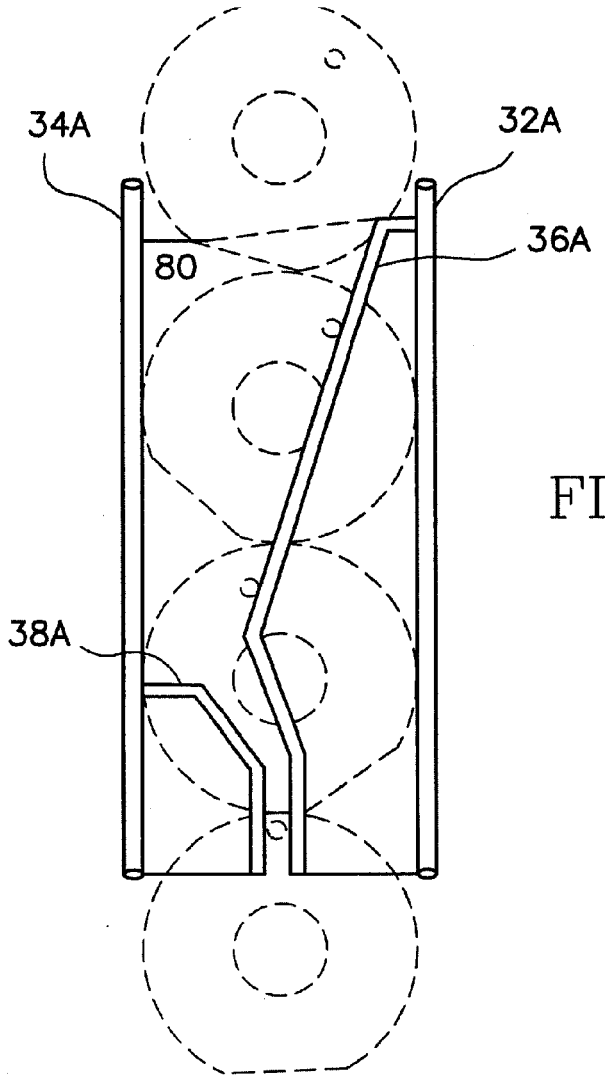
Figure 7A:
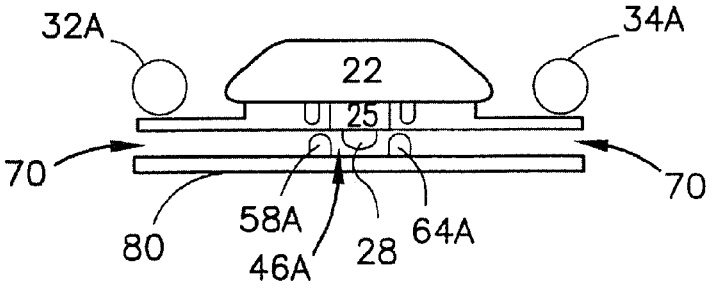
Figure 8:
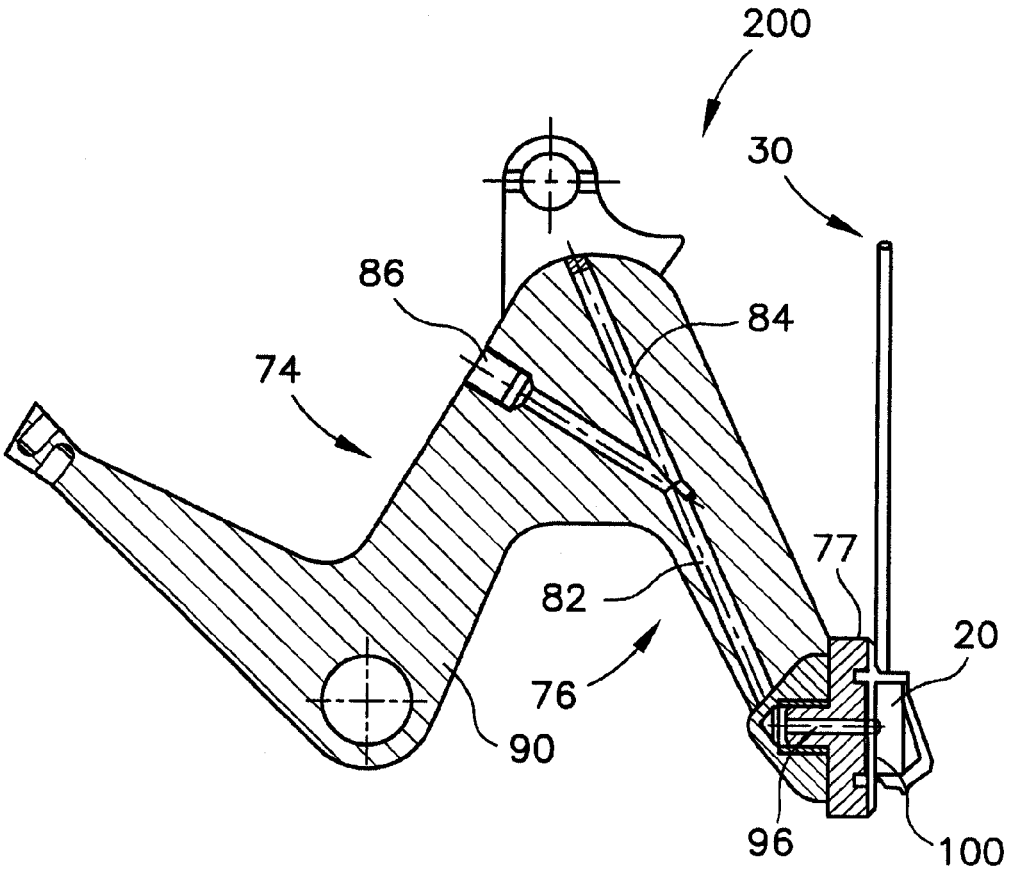
Figure 9:
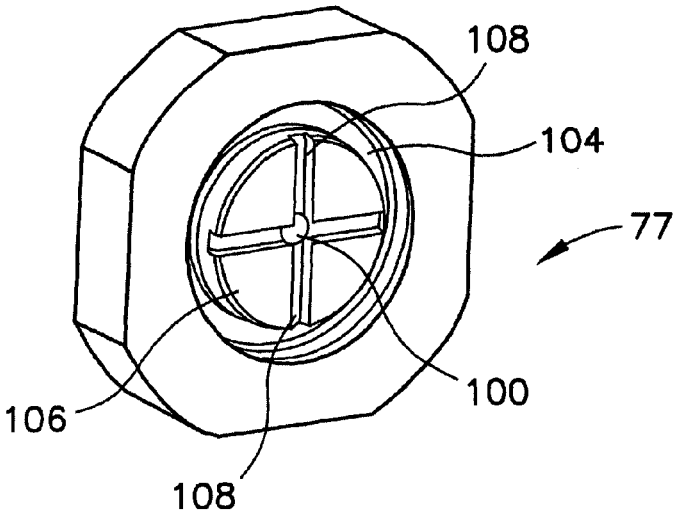
Figure 10:
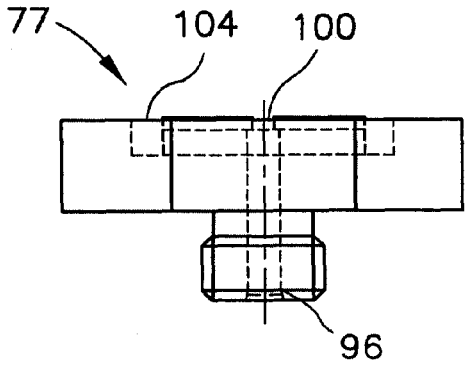
Figure 11:
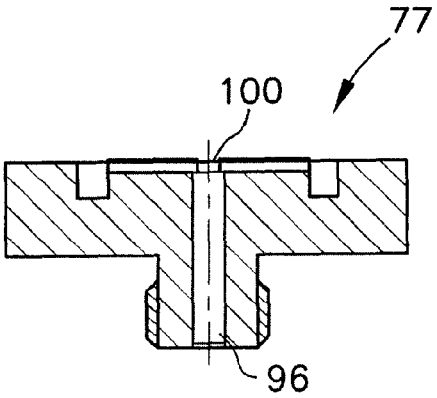
Figure 12:
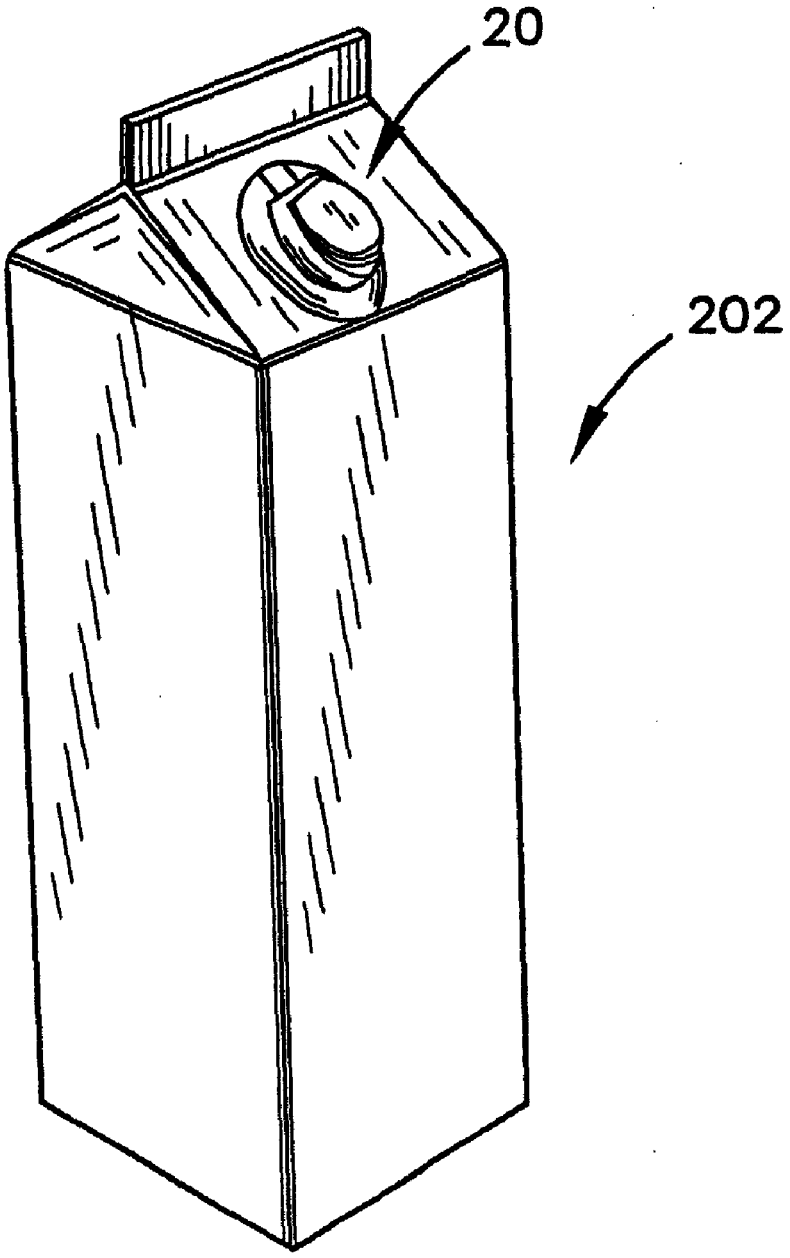

There is illustrated in FIG. 2 a side plan view of the closure of FIG. 1;

There is illustrated in FIG. 3 a front plan view of the closure orienting device and a vacuum holding device of the present invention at one point in time;

There is illustrated in FIG. 4 a front plan view of the closure orienting device of the present invention at a second point in time;

There is illustrated in FIG. 5 a front plan view of the closure orienting device of the present invention at a third point in time;

There is illustrated in FIG. 6 a front plan view of the closure orienting device of the present invention at a fourth point in time;

There is illustrated in FIG. 6A a cross-sectional view of line II—II of FIG. 6;

There is illustrated in FIG. 7 a front plan view of the closure orienting device of the present invention with a plurality of closures being oriented on the device;

There is illustrated in FIG. 7A a cross-sectional view of FIG. 7;

There is illustrated in FIG. 8 a cross-sectional view of the anvil and vacuum holding device of the present invention;

There is illustrated in FIG. 9 a perspective view of the face of the vacuum holding device of the present invention;

There is illustrated in FIG. 10 a top plan view of the front of the vacuum holding device of the present invention;

There is illustrated in FIG. 11 a cross-sectional view of the front of the vacuum holding device of FIG. 10;

There is illustrated in FIG. 12 a perspective view of a carton with a closure thereon.

DETAILED DESCRIPTION OF THE INVENTION

FIGS. 1 and 2 illustrate a closure 20 of the present invention which is applied to a carton in order to access the contents of the carton. The closure has a cap 20, a spout 24, a hinge 25, a flange 26, a flat portion of a flange 27 and an orienting projection 28. Closures similar to the one illustrated in FIGS. 1 and 2 have been disclosed in copending U.S. patent applications Ser. Nos. 08/812,319 (Orientationally Sensitive Closure And Orienting Apparatus Therefor), 08/856,350 (Cut-Out Integrated Closure And Forming Method Therefor), 08/958,996 (One-Piece Molded Flip Cap Closure), 08/958,995 (One-Piece Molded Flip Cap Closure), and 08/648,806 (Closure Formed As A Single, Integral Part), all of which are hereby incorporated by reference.

The flat portion 27 of the flange assists in having the closure 20 the rests in the proper position for engagement with a spud of an anvil as described below. The orienting projection 28 guides the closure 20 through an orienting device 30 as shown in FIGS. 3–7.

FIGS. 3–7 illustrate the closure 20 at different points in time as the closure 20 is oriented on the orienting device 30. In a basic embodiment, the orienting device 30 is composed of a series of parallel rods 32A–B and 34A–B, a first multi-angled edging 36, a second multi-angled edging 38, and a general channel 40. The parallel rods 32A and 34A lie on one plane, parallel rods 32B and 34B lie on another plane, with the edgings 36 and 38 on yet another plane, and the channel 40 defining yet a fourth plane. The general channel 40 may be further partitioned into an upper channel 42, a middle channel 44 and a lower channel 46. The edgings 36 and 38 may be stand-alone rods or may be a raised edge on a first plate 48 and a second plate 50. Alternatively, one or the other plates 48 and 50 may be present while the other 48 or 50 is absent. The first multi-angled edging 36 may be further partitioned into a first perpendicular edge 52 connected to a first declined edge 54 connected to a first inclined edge 56 connected to a first parallel edge 58. The second multi-angled edging 38 may be further partitioned into a second perpendicular edge 60 connected to a second declined edge 62 connected to a second parallel edge 64. Although the edgings 36, 38 have been particularly described, those skilled in the relevant arts will recognize that other angles of edging may be employed without departing from the scope and spirit of the present invention.

FIGS. 3–7 illustrate a plan view of the orienting device 30 with a closure 20 or closures being oriented thereon. The top of the closure 20 is facing outward, however the main function of the closure 20 is operable from its bottom, that being the orienting projection 28. Thus, the closure will be shown as outlined to emphasize the action of the orienting projection 28. The closures 20 are supplied from a hopper 66, not shown, which is connected to the orienting device 30 via a chute 68, not shown. No matter what the orientation, or angle, of the closures 20 as each closure 20 emerges from the chute 68, the orienting device 30 will properly orient the closure once the closure 20 emerges from the orienting device 30.

As a closure enters the orienting device 30, the perimeter of the flange 26 engages with the parallel rods 32A and 34B. The flange enters a flange channel 70 which is defined by the parallel rods 32A–B and 34A–B with rods 32A and 34A defining one side of the channel 70 and rods 32B and 34B defining the other side of the channel 70 which is best seen in FIG. 6A. Thus, the very perimeter edging of the flange 26 is trapped between rods 32A–B and 34A–B which directs the closure 20 downward thereby preventing outward, transversal, movement of the closure 20.

Once the closure 20 has entered the orienting device 30, the orienting projection 28 engages with the edging 36 or 38, as shown in FIG. 4. The orienting projection 28 maneuvers within the general channel 40 and depending on the orientation of the closure 20 as it leaves the chute 68, the projection 28 may first engage with the first multi-angled edging 36 or the second multi-angled edging 38. The projection 28 may "bounce" between the edging 36 and 38 as the closure 20 drops through the orienting device 30.

Eventually the projection 28 will enter the middle channel 44 as shown in FIG. 5. At this point in time, the closure 20 is being readied for proper positioning for engagement with the face 72 of anvil 74, not shown. The face 72 may be an engagement mechanism of a vacuum holding device 76 or a spud of a traditional anvil 74. Such is described below in reference to the vacuum holding device 76. A proper position/orientation has the flat portion 27 of the flange 26 exiting the orienting device 30 first and perpendicular to the parallel rods 32A–B and 34A–B. However, with closures 20 that do not have a flat portion 27, the proper orientation has the cap 22 able to open upward toward the orienting device 30 with the hinge 25 at the top of the closure 20.

FIG. 6A illustrates a cross-sectional view of a closure 20 within the orienting device 30. The projection 28 is within the lower channel 46 which is the most narrow channel of the three sub-channels 42,44 and 46 of the general channel 40. The flange 26 lies within the flange channel 70. Alternatively, parallel rods 32B and 34B may be integrated with plates 48 and 50, or even absent, with only the plates 48 and 50 defining the second side of the flange channel 70. In such an embodiment as shown in FIG. 7, the orienting device 30 would be composed of essentially a flat body 80 which has edgings 36A and 38B protruding therefrom, and also parallel rods 32A and 34A. The general channel 40A would be defined by the edgings 36A and 38A. As shown in FIG. 7A, The flat body 80 has edgings 58A and 64A protruding therefrom which define the lower channel 46A. Parallel rods 32A and 34A along with the flat body 80 define the flange channel 70. The projection 28 still resides in lower channel 46A. Also, FIG, 7 demonstrates how a plurality of closures 70 being continually fed from the chute 68 would maneuver through the orienting device 30 and become properly oriented no matter what orientation the closures 20 possessed when each closure entered the orienting device 30.

The vacuum holding device 76 is shown in FIG. 8 which is a cross-section view of an anvil 74 of a fitment applicator device. Such a fitment applicator device is disclosed in U.S. Pat. No. 5,601,669 which is hereby incorporated by reference. However, the vacuum holding device 76, as well as the orienting device 30, may be utilized with many fitment applicators such as those disclosed in copending U.S. patent application Ser. No. 08/710,619 (Process and Apparatus For Applying Fitments To A Carton) and U.S. Pat. No. 5,484,374, both of which are hereby incorporated by reference.

The vacuum holding device 76 is integrated within the anvil 74. The vacuum holding device 76 is composed of an engagement piece 77, a central vacuum passage 82, an ancillary passage 84, and a vacuum tube engagement 86. The passages 82 and 84 are integrated within the body 90 of the anvil 74. One end of a tube 92, not shown, is placed within engagement 86 while the other end of the tube 92 is connected to a pressure control source 94, not shown. The pressure control source 94 may exert a vacuum by evacuating air from the various passageways, or when necessary operate in reverse to increase the pressure through the passageways. When a vacuum is exerted, air is evacuated through the tube 92 through the passage 82 from the engagement piece 77, through an engagement passage 96 and through an aperture 100 for attachment of a closure 20 thereto. Once the closure/fitment 20 is attached to the engagement piece 77, the anvil 74 may be operated as described in any of the above incorporated patents or application. Once the anvil is maneuvered to a container, the pressure control source 94 is reversed thereby increasing the pressure in the passageways which results in the closure being "blown off" the engagement piece 77 substantially simultaneously with the attachment of the closure 20 to the container, either by ultrasonic welding or other means such as hot melt adhesion. The timing of the reversal of the pressure control source 94 is controlled by a programmable logic control ("PLC") which also controls the movement of the anvil and attachment device.

FIGS. 9–11 illustrate the engagement piece 77 of the vacuum holding device. The face 102 of the engagement piece 77 may have an annular groove 104 encircling a lobe 106 on which the aperture 100 is located for exerting the vacuum therefrom. The lobe 106 may also have a series of lobe channels 108 thereon for allowing the projection 28 to rests within during capture of a closure 20 on the engagement piece 77. The operation of vacuum holding device is described with the operation of the entire system 200 as described below.

A plurality of closures 20 are fed from a hopper 66 through a chute 68 to the orienting device 30. At the orienting device 30, the closures 20 are properly oriented for placement on a carton no matter what orientation the closures 20 possess when entering the orienting device 30. Gravity assists in the orienting of the closure 20 as it maneuvers through the channels 40–46 and 70 of the orienting device 30. At the bottom of the orienting device 30, the closure is positioned with the cap able to be opened upward if the closure is a flip cap closure. Alternatively, a non-flip cap closure will have a proper orientation corresponding to the opening mechanism.

Once in a proper position, an anvil 74 may engage the closure 20 for positioning about a carton or container. The anvil 74 may position the closure 20 within an openended carton or attach the closure 20 to the exterior of a sealed carton. The anvil 74 may engage the closure 20 with a spud 72, or if the anvil 74 is integrated with the vacuum holding device 76 of the present invention, it may engage the closure 20 with an engagement piece 77 which has an aperture in flow communication with a pressure control source 94 for exerting a vacuum on the closure 20 for retention to the engagement piece 77 during movement of the anvil 74. The anvil 74 will move from a closure/fitment attachment station to the carton for attachment of the closure 20 thereon.

If the vacuum holding device 20 of the present invention is utilized, a vacuum is exerted during the engagement of a closure 20 to the anvil 74, and maintained until the closure 20 is permanently affixed to the carton. A sealed carton 202 with a closure there attached is shown in FIG. 12. The present invention may be integrated on a form, fill and seal packaging machine, or positioned before or after the machine for attachment of a closure to a blank or sealed carton respectively.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims:

We claim as our invention:

1. An apparatus for orienting a closure for attachment to a container, the closure having a flange having a spout extending from a side thereof centrally positioned on and coaxial with the flange, and an orienting projection extending from an opposite side of the flange, the flange having a width and the orienting projection having a shorter width than the flange, the apparatus comprising:

a first and second edging defining a projection receiving channel, the projection receiving channel having a receiving end and a dispensing end, at least one bend therein defining a portion extending generally transverse, in part, relative to a longitudinal axis thereof, the projection receiving channel including an upper channel having a first width, a middle channel having a second width smaller than the first width, and a lower channel having a third width smaller than the second width; and a flange receiving channel defined by a plurality of longitudinal bars extending at least the length of the first and second edging and in proximity thereof as to maintain the flange within the flange receiving channel.

2. The apparatus according to claim 1 further comprising a flat body, the first and second edging protruding from the flat body.

3. The apparatus according to claim 1 wherein the closure is a flip cap closure.

4. The apparatus according to claim 1 wherein the first edging comprises a first perpendicular edge, a first declined edge, a first inclined edge and a first parallel edge.

5. The apparatus according to claim 4 wherein the second edging comprises a second perpendicular edge, a second declined edge and a second parallel edge.

6. The apparatus according to claim 1 wherein the first and second edging are each a single rod.

7. The apparatus according to claim 1 further comprising a third and fourth longitudinal rods positioned in parallel with the first and second longitudinal rods respectively.

8. The apparatus according to claim 1 further comprising a vacuum holding device disposed at the bottom of the orienting apparatus.

9. A orienting closure system for attaching an orientationally sensitive closure on a container, the system comprising:

an orientationally sensitive closure having a flange with first and second sides with a flat section along its perimeter, a spout extending from the first side, and an orienting projection extending from the second side of the flange;

an orienting apparatus comprising a first and second edging defining a projection receiving channel, the projection receiving channel having a receiving end and a dispensing end, and at least one bend therein defining a portion extending generally transverse, in part, relative to a longitudinal axis thereof, the projection receiving channel including an upper channel having a first width, a middle channel having a second width smaller than the first width, and a lower channel having a third width smaller than the second width, and a flange receiving channel defined by a plurality of longitudinal bars extending at least the length of the first and second edging and in proximity thereof as to maintain the flange within the flange receiving channel; and an anvil.

10. The system according to claim 9 wherein the orienting apparatus further comprises a flat body, the first and second edging protruding from the flat body.

11. The system according to claim 9 wherein the first edging comprises a first perpendicular edge, a first declined edge, a first inclined edge and a first parallel edge.

12. An apparatus for orienting a closure for attachment to a container, the closure having a flange having a spout extending from a side thereof centrally positioned on and coaxial with the flange, and an orienting projection extending from an opposite side of the flange, the flange having a width and the orienting projection having a shorter width than the flange, the apparatus comprising:

a first and second rod defining a projection receiving channel, the projection receiving channel having a receiving end and a dispensing end, at least one bend therein defining a portion extending generally transverse, in part, relative to a longitudinal axis thereof; and a flange receiving channel defined by a plurality of longitudinal bars extending at least the length of the first and second rod and in proximity thereof as to maintain the flange within the flange receiving channel.

* * * * *

UNITED STATES PATENT AND TRADEMARK OFFICE

CERTIFICATE OF CORRECTION

PATENT NO. : 5,992,129
DATED : November 30, 1999
INVENTOR(S) : Tuckner et al.

It is certified that error appears in the above-identified patent and that said Letters Patent is hereby corrected as shown below:

Drawings,
Replace Figs. 1-18, (Sheets 1-13), with the attached Figs. 1-12 (Sheets 1-10).

Signed and Sealed this

Seventeenth Day of August, 2004

JON W. DUDAS
*Acting Director of the United States Patent and Trademark Office*